US005453599A

United States Patent [19]

Hall, Jr.

[11] Patent Number: 5,453,599

[45] Date of Patent: Sep. 26, 1995

[54] TUBULAR HEATING ELEMENT WITH INSULATING CORE

[75] Inventor: Bertie F. Hall, Jr., Ann Arbor, Mich.

[73] Assignee: Hoskins Manufacturing Company, Detroit, Mich.

[21] Appl. No.: 195,376

[22] Filed: Feb. 14, 1994

[51] Int. Cl.[6] ..... H05B 3/48; H05B 3/44

[52] U.S. Cl. ..... 219/544; 219/538; 219/546; 219/552; 219/553

[58] Field of Search ..... 219/538, 544, 219/546, 552, 553; 338/300, 265, 312, 321, 314, 302

[56] References Cited

U.S. PATENT DOCUMENTS

| | | | |
|---|---|---|---|
| 1,127,281 | 2/1915 | Read . | |
| 1,247,210 | 11/1917 | Black | 338/265 |
| 1,303,404 | 5/1919 | Simon | 338/300 |
| 1,432,434 | 10/1922 | Abbott | 338/312 |
| 2,074,777 | 3/1937 | Coupier | 205/18 |
| 2,096,635 | 10/1937 | Goodwin | 338/302 |
| 2,337,202 | 12/1943 | Jones | 338/300 |
| 2,866,062 | 12/1958 | Fisher | 219/544 |
| 3,067,315 | 12/1962 | Hurko | 219/546 |
| 3,172,074 | 3/1965 | Drewes | 338/300 |
| 3,297,818 | 1/1967 | McCleery | 174/106 |
| 3,329,922 | 7/1967 | Steil | 338/300 |
| 3,621,204 | 11/1971 | Neidhardt | 219/553 |
| 3,626,353 | 12/1971 | Loose | 338/300 |
| 3,793,560 | 2/1974 | Schultheis | 361/104 |
| 3,950,604 | 4/1976 | Penneck | 338/314 |
| 4,080,510 | 3/1978 | Beck | 219/552 |
| 4,080,726 | 3/1978 | Neimanns et al. | 29/611 |
| 4,117,312 | 8/1978 | Johnson et al. | 219/548 |
| 4,506,251 | 3/1985 | Naruo et al. | 338/238 |
| 4,679,317 | 7/1987 | Bailleul et al. | 29/828 |
| 4,689,443 | 8/1987 | Bailleul | 174/102 |
| 4,810,858 | 3/1989 | Urban | 219/469 |

*Primary Examiner*—Teresa J. Walberg
*Assistant Examiner*—Sam Paik
*Attorney, Agent, or Firm*—Brooks & Kushman

[57] ABSTRACT

A tubular heating element (10) having a metal tube (12) filled with a ceramic material (14). The metal tube has a near zero or slightly positive temperature coefficient of resistance. In an alternative embodiment, a wire (16) is coaxially supported within the metal tube (12) by the ceramic material (14). This wire may be used to stiffen the tubular heating element (10) or may be used as an electrical conductor.

25 Claims, 1 Drawing Sheet

TUBULAR HEATING ELEMENT WITH INSULATING CORE

TECHNICAL FIELD

The invention is related to the field of electric heating elements and in particular to a tubular electric heating element with an insulating core.

BACKGROUND ART

Heating elements consisting of a resistive heating wire enclosed is a metal sheath are known in the art. The sheathed resistance heater taught by Naruo et al in U.S. Pat. No. 4,506,251 is typical of such a heating element. This sheathed resistance heater consists of a heating wire coaxially supported in a metal sheath by an electrically insulating powder. Similar heating elements are taught by Neemanns et al in U.S. Pat. No. 4,080,726, Neidhardt et al in U.S. Pat. No. 3,621,204 and Read in U.S. Pat. No. 1,127,281.

The problem with these electric heater elements is that the resistivities of the metal alloys which are resistant to oxidation and corrosion at elevated temperatures are relatively low. Therefore, to achieve the desired resistance, either the diameter of the heater wire must be relatively small or considerable lengths are required. Reducing the diameter of the heater wire makes it relatively sensitive to oxidation or corrosion and therefore subject to failure. Reducing the diameter of the wire heater also increases the surface loading required to achieve the desired radiated heat energy.

Alternatively, increasing the length of the wire to obtain the desired electrical resistance increases the total quantity of the heater wire required which, in turn, increases the cost of the electric heater element. Increasing the length of the wire often results in excessive bulk which may cause packaging problems.

What is needed is a heater element in which the resistivity of the metal heater is effectively increased, permitting shorter lengths and lower surface loading.

SUMMARY OF THE INVENTION

The invention is a heater element consisting of a metal tube filled with an insulating ceramic material. The diameter of the metal tube can be selected to produce the desired surface loading while the cross-sectional area of the metal tube and its length can be selected to produce a desired resistance and a desired surface load. In a second embodiment, a wire element may be coaxially supported in the metal by the ceramic powder to increase the structural rigidity of the heater element.

One advantage of the tubular heating element is that its diameter can be selected to produce a desired surface loading.

Another advantage of the tubular heater element is that the cross-sectional area of the metal tube may be selected to produce a desired linear resistivity.

Still another advantage of the tubular heater element is that a coaxial wire may be used to improve the rigidity of the tubular heater element.

Further, another advantage of a coiled tubular heater element is that it is structurally more rigid than a coiled solid wire.

Yet another advantage is that a hardenable wire may be coaxially supported within the metal heater tube to stiffen the heater element after forming by heat treatment.

These and other advantages of the tubular heater element will become more apparent from a reading of the specification in conjunction with the drawings.

DETAILED DESCRIPTION OF THE INVENTION

Figure 1:
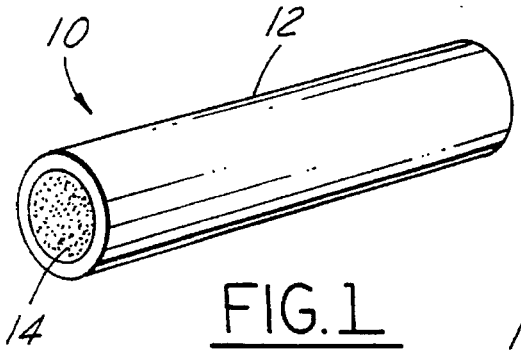
FIG. 1 is a perspective view of a first embodiment of the tubular heating element.

The details of a first embodiment of the tubular heating element are shown in FIG. 1. The tubular heating element 10 has a metal tube 12 filled with an insulating mineral powder 14 such as magnesium oxide. Alternatively, the metal tube 12 may be filled with a PTC (positive temperature coefficient) conductive ceramic powder in place of the insulating mineral powder. The metal tube 12 is made from a metal alloy such as Chromel-C or any other alloy having a near zero or a slightly positive temperature coefficient of resistance. Constantan and various nickel-chromium alloys meet these criteria. The outside diameter (OD) and inside diameter (ID) of the metal tube 12 are selected to produce desired linear electrical resistivity. The heating element may be made using any conventional method used to fabricate metal tubes. In the preferred embodiment, the metal tube 12 is a ceramic filled welded seam tube fabricated using known welded seam tube manufacturing techniques such as taught by Lewis in U.S. Pat. No. 4,269,639. After fabrication, the heating element is drawn to the desired outside diameter. The insulating material 14 is used to prevent the metal tube 12 from collapsing while it is being drawn down to the desired diameter.

The advantages of the tubular heating element 10 may best be described by way of an example of a commercial application such as a heating element for an electric clothes dryer. Conventionally, this heating element consists of a solid 16-gauge (0.0508 inch diameter) Chromel-C solid wire having a 10 ohm cold resistance and an 11 ohm resistance at its operating temperature. The cold linear resistance of the Chromel-C wire is approximately 0.26 ohms per ft., therefore a Chromel-C wire approximately 38.5 feet long is required to produce the desired resistance. This solid wire heating element has a weight of approximately 0.28 pounds. In operation, approximately 240 volts are applied across the solid wire heating element, producing 5,200 watts of heat energy. The surface loading, i.e., heat radiated per square inch of surface area, of this solid wire heating element is 70.5 watts/inch$^2$.

This same surface loading may be achieved with a tubular heating element 10 having a Chromel-C metal tube whose cross-sectional area is approximately 22% of the total cross-sectional area of metal tube 12. The metal tube 12 for example may have 0.084 inch O.D. and a 0.074 inch I.D. The linear resistivity of this metal tube is approximately 0.427 ohms per foot; therefore only 23.5 feet are required to produce the desired 10 ohm total resistance. The weight of this tubular heating element is approximately 0.1 pounds which represents a 64% reduction in the amount of the metal required to make the tubular heating element.

In a second example, the cross-sectional area of the metal tube sheath is 40% of the total cross-sectional area of the tubular heating element. For example, the metal tube 12 may have a 0.067 inch OD and a 0.052 inch ID. The linear resistance of this metal tube is approximately 0.378 ohms and requires a length of 27 feet to produce the desired 10 ohm resistance. The weight of this tubular heating element is approximately 0.14 pounds, which is approximately one-half (½) the weight of the equivalent heating element made from the 16-gauge solid wire.

Both embodiments of the tubular heating element described above would operate at the same temperature as the solid wire heating element, but because of their larger diameter would last longer.

In an alternate example of the advantages of the tubular heating element 10, consider a tubular heating element 10 whose metal tube 12 has the same linear resistance as the solid wire heating element described above, has the same length, and has a cross-sectional area which is 22% of the total cross-sectional area of the tubular heating element 10. In this embodiment, the metal tube 12 would have a 0.109 inch OD and a 0.096 inch ID. The weight of the metal tube is the same as the weight of the solid Chromel-C wire, however, its surface load would be reduced to approximately 33 watts/inch$^2$. This lower surface load would significantly reduce the surface temperature of the tubular heating element 10 and substantially increase its life.

Figure 2:
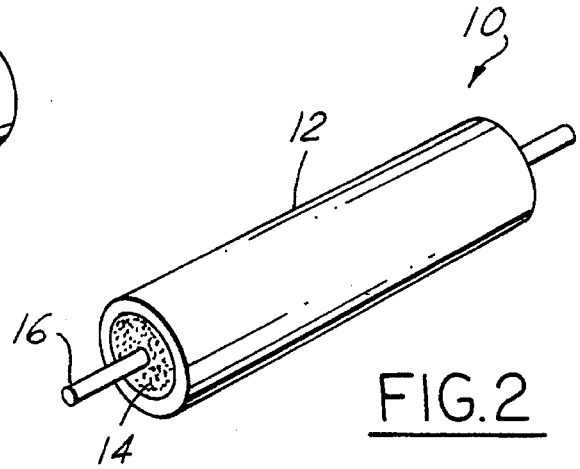
FIG. 2 is a perspective view of a second embodiment of the tubular heating element.

A second embodiment of the tubular heating element 10 is shown in FIG. 2. In this embodiment, a wire 16 is coaxially supported within the metal tube 12 and is electrically insulated therefrom by the ceramic powder 14. The wire 16 may be a single solid wire, a plurality of wires, or a braided wire. This wire 16 may perform a variety of functions as discussed below. The wire 16 may be used to provide rigidity to the tubular heating element 10 during the forming process. The wire 16 may provide rigidity to the tubular heating element 10 at room and elevated temperatures. The wire 16 also may be made from an hardenable metal and used to stiffen the finished tubular heating element 10, after being formed, by heat treating. Also, the wire 16 may be made from a metal such as copper or any other metal or alloy having a low electrical resistivity or be made from a material used to provide a temperature control to avoid catastrophic overheating as shall be explained relative to FIG. 5.

Figure 3:
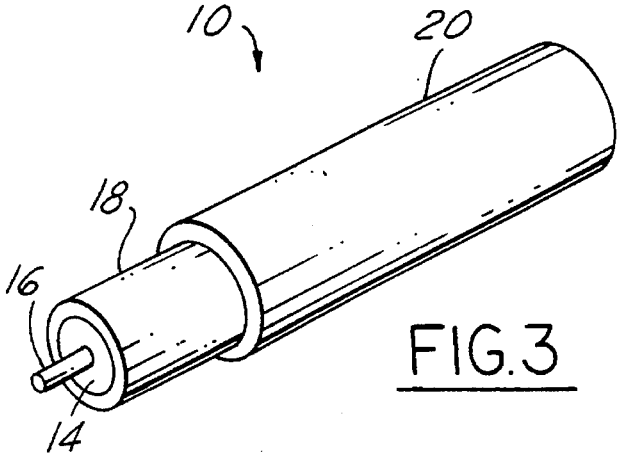
FIG. 3 is a perspective view of a third embodiment of the tubular heating element.

As shown in FIG. 3, the metal tube 12 may be overlayed with one or more layers of different metals or alloys to provide a performance superior to the performance attainable from any single alloy alone. In the embodiment shown in FIG. 3, the metal tube 12 consists of an inner tube 18 having an outer layer 20 disposed thereon. It is recognized that additional layers may be used as desired.

In a first example, an alloy having good hot strength may be selected for the inner tube 18 and an alloy having good oxidation or corrosion resistance may be selected for the outer layer 20. The outer layer 20 will protect the inner tube 18 from oxidation and corrosion. Alternately, the outer layer 20 may be made from a premium heat resistant alloy and the inner tube may be made from a less expensive alloy.

The tubular heating element shown in FIG. 3 may have a solid coaxial wire 16 as shown and described relative to FIG. 2 or the solid coaxial wire may be omitted, as shown in FIG. 1.

Figure 4:
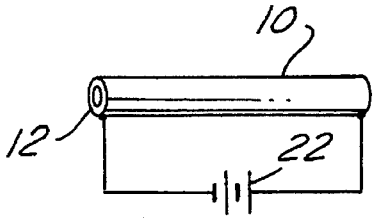
FIG. 4 shows a first circuit arrangement of the tubular heating element of FIG. 1 with a source of electrical power.

Referring now to FIG. 4, a source of electrical power, illustrated as battery 22, may be electrically connected to the opposite ends of the metal tube 12 of the tubular heating element 10. It is recognized that although the source of electrical power 22 is illustrated as a battery, the source of electrical power may be an alternating current generator or electrical power received from conventional commercial or household alternating current electrical power outlets.

Figure 5:
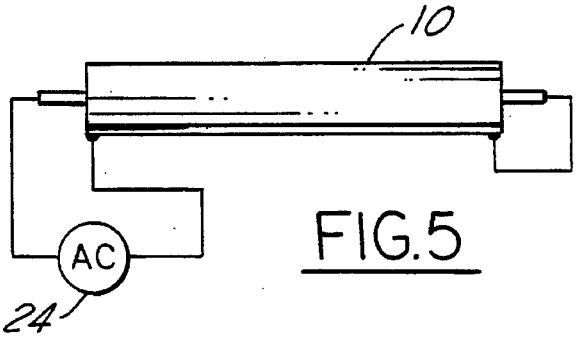
FIG. 5 shows a second circuit arrangement of the tubular heating element of FIGS. 2 or 3 with a source of electrical power.

In FIG. 5, one output terminal of an alternating source of electrical power 24 is electrically connected to one end of the metal tube 12 and the other terminal of the source of electrical power 24 is connected to one end of the coaxial wire 16. The opposite end of the coaxial wire 16 is connected to the opposite end of the metal tube 12 completing the circuit between the terminals of the source of electrical power 24. With this arrangement, the coaxial wire 16 may be made from an alloy which will melt when the current through the metal tube approaches a value preselected to prevent a catastrophic failure of the tubular metal heater 10. Alternatively, the wire 16 may be made from an alloy having a positive temperature coefficient of resistance such that when the current through the metal tube 12 exceeds a predetermined value, the resistivity of the wire 16 rapidly increases, thereby maintaining the current flow through the metal tube 12 at a value less than a current sufficient to produce catastrophic failure of the tubular heating element 10.

Figure 6:
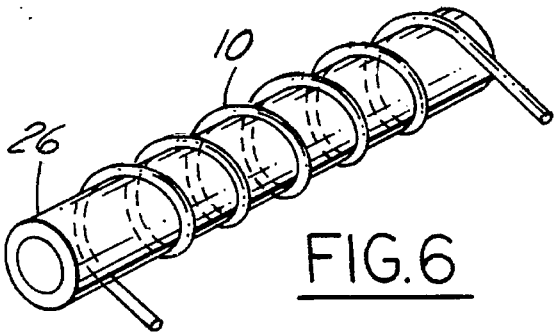
FIG. 6 shows a tubular heating element wound around a ceramic tube.
Figure 7:
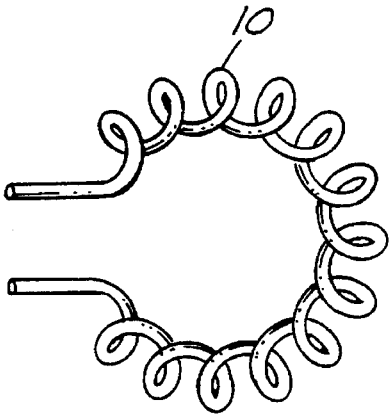
FIG. 7 shows a tubular heating element in a self standing coiled configuration.

The tubular heating element 10 may be used in the same manner as a conventional solid wire heating element. As shown in FIG. 6, the tubular heating element may be wound around a ceramic cylinder 26, or may be coiled or may be spiral wound as shown in FIG. 7 to form a free standing heater.

The disclosed tubular heating element has many operational and economic advantages over solid wire heating elements:

- The tubular heating element can have a higher linear resistance than comparable solid wire heating elements having approximately the same diameter.
- The tubular heating element can reduce the quantity of a premium resistive alloy required to make a heating element having the desired resistance and surface load.
- The tubular heating element can reduce surface loading on the heater element having the desired resistance.
- The tubular heating element can operate at lower surface temperatures, thereby increasing its life.

It is recognized that while various embodiments of the invention have been shown in the drawings and discussed in the specification, those skilled in the art may make changes and/or improvements to the tubular heating element as set forth in the appended claims.

What is claimed is:

1. A tubular heating element comprising:

a preformed metal tube having a predetermined temperature coefficient of resistances, wherein an electrical current passes through the preformed metal tube to generate heat;

a ceramic material disposed in and filling said preformed tube, the tubular heating element; and a single, continuous metal wire coaxially supported in said metal tube along the entire length of said metal tube by said ceramic material.

2. The tubular heating element of claim 1 wherein said wire has a mechanical strength greater than said metal tube to provide rigidity to said tubular heating element.

3. The tubular heating element of claim 1 wherein said wire has a low electrical resistivity.

4. The tubular heating element of claim 1 wherein said wire has a temperature coefficient of resistance more positive than the temperature coefficient of resistance of said metal tube.

5. The tubular heating element of claim 1 wherein said wire is an age hardenable material.

6. The tubular heating element of claim 3 wherein said ceramic material comprises magnesium oxide.

7. A tubular heating element of claim 1 wherein said preformed metal tube comprises at least an inner tube of a first alloy and an outer layer of a second alloy; said outer layer extending the length of said inner tube.

8. The tubular heating element of claim 7 wherein said inner tube is made from an alloy having good hot strength and said outer layer is made from an alloy having good oxidation resistance.

9. The tubular heating element of claim 7 wherein said inner tube is made from an alloy having good hot strength and said outer layer is made from an alloy having good corrosion resistance.

10. The tubular heating element of claim 7 wherein said outer layer is made from a premium heat resistant alloy and said inner tube is made from an alloy having good working and drawing properties.

11. The tubular heating element of claim 7 further comprising a metal wire coaxially supported in said metal tube by said ceramic material.

12. The tubular heating element of claim 1 wherein the cross-sectional area of the metal portion of said preformed metal tube is greater than 20% of the total cross-sectional area of the preformed metal tube.

13. The tubular heating element of claim 12 wherein said cross-sectional area of the metal portion of said preformed metal tube is in the range from 20% to 40% of the total cross-sectional area of the preformed metal tube.

14. A tubular heating element comprising:

a preformed metal tube having a predetermined temperature coefficient of resistance, whereby an electrical current passes through the preformed metal tube to generate heat;

a single, continuous wire coaxially disposed in said preformed metal tube along the entire length of the tube; and a ceramic material filling said preformed metal tube and mechanically supporting said wire coaxially within said preformed metal tube.

15. The tubular heating element of claim 14 wherein said predetermined temperature coefficient of resistance is a positive temperature coefficient of resistance.

16. The tubular heating element of claim 14 wherein said metal tube comprises at least an inner metal tube and an outer metal layer disposed on said inner metal tube, said outer metal layer extending the entire length of said inner metal tube.

17. The tubular heating element of claim 15 wherein said wire has a mechanical stiffness greater than said metal tube.

18. The tubular heating element of claim 14 wherein the cross-sectional area of the metal portion of said preformed metal tube is greater than 20% of the total cross-sectional area of the preformed metal tube.

19. The tubular heating element of claim 18 wherein the cross-sectional area of said metal portion is in the range from 20% to 40% of the total cross-sectional area of said preformed metal tube.

20. A tubular heating element comprising:

a preformed inner metal tube;

an outer metal layer overlaying said inner metal tube, at least one of said inner metal tube and said outer metal layer having a predetermined temperature coefficient of resistance; and a ceramic material filling said inner metal tube.

21. The tubular heating element of claim 20 further comprising a wire coaxially supported in said inner metal tube along the entire length of said metal tube by said ceramic material.

22. The tubular heating element of claim 20 said inner metal tube has good hot strength and said outer metal layer has good corrosion resistance.

23. The tubular heating element of claim 20 wherein said inner metal tube has good hot strength and said outer metal layer has good oxidation resistance.

24. The tubular heating element of claim 20 wherein the cross-sectional area of the metal portion of said preformed inner metal tube is greater than 20% of the total cross-sectional area of said preformed inner metal tube.

25. The tubular heating element of claim 24 wherein the cross-sectional area of the metal portion of said preformed inner metal tube is in the range from 20% to 40% of the total cross-sectional area of said preformed inner tube.

* * * * *